United States Patent [19]

Ellis

[11] Patent Number: 4,793,728

[45] Date of Patent: Dec. 27, 1988

[54] SUBSURFACE WATER DRAINAGE SYSTEM

[75] Inventor: Donn W. Ellis, Brighton, Mich.

[73] Assignee: Construction Supply, Inc., Highland, Mich.

[21] Appl. No.: 49,856

[22] Filed: May 13, 1987

[51] Int. Cl.[4] ..... E01C 11/22

[52] U.S. Cl. ..... 404/2; 404/3; 405/50; 285/176; 285/178; 285/260

[58] Field of Search ..... 404/2–4; 52/169.5, 169.14; 405/43, 45, 50; 210/170, 747; 285/176, 178, 260, 903

[56] References Cited

U.S. PATENT DOCUMENTS

| | | | |
|---|---|---|---|
| 3,695,643 | 10/1972 | Schmunk | 285/903 X |
| 3,727,953 | 4/1973 | Martin et.al. | 285/903 X |
| 4,490,072 | 12/1984 | Glasser | 405/45 |
| 4,597,693 | 7/1986 | McQuay et al. | 404/2 X |
| 4,639,165 | 1/1986 | Flecknor-Brown | 405/43 X |

OTHER PUBLICATIONS

Monsanto Chemical Company Brochure Hydraway Drain.

*Primary Examiner*—Jerome W. Massie, IV
*Assistant Examiner*—John F. Letchford
*Attorney, Agent, or Firm*—Gifford, Groh, VanOphen, Sheridan, Sprinkle and Dolgorukov

[57] ABSTRACT

A drainage system located adjacent a pavement subbase includes a tube of a geotextile fabric supported by a self-sustaining water-porous plastic support. An end of the fabric tube and its encased support are compressively received in the flared open end of an outlet connected to a conventional drainpipe. The outlet includes a plurality of projections which trap the fabric tube between the support and the outlet, so as to securely retain it therein. The outlet also preferably includes a plurality of circular beads over which the corrugated drain tube can be frictionally slipped. Alternatively, the outlet can be configured as a flat union of T-shaped junction joining one or more upstream fabric tube-and-support filters with a downstream outlet constructed from an identical fabric tube and support.

23 Claims, 3 Drawing Sheets

SUBSURFACE WATER DRAINAGE SYSTEM

BACKGROUND OF THE INVENITON

I. Field of the Invention

The present invention is directed to a system for water drainage, and more particularly to a subsurface system for draining water from beneath covered ground, such as the subbase of a roadway.

II. Description of the Prior Art

A major cause of damage to road surfaces is the entrapment or retention of water beneath the road surface, in the road base or subbase. Such retained water can cause potholes, buckles and gaps in the pavement, as well as cracking or crumbling of the pavement, and can lead to premature collapse or failure of the roadbed. Rapid subsurface drainage of the roadbed is thus critical to extending the useful life of the highway.

The Hydraway drain (trademark of Monsanto Chemical Company, St. Louis, Mo. is a known drainage system useful for this purpose. It comprises a tubular, internally supported geotextile fabric filter disposed in the ground beneath or preferably adjacent a covered ground surface, for example, in the subbase of a highway or pavement. The filter support is constructed of a somewhat rigid but resiliently deformable polyethylene core, about which the filter is circumferentially disposed, and to which the filter is bonded. This known drain is asserted to have flow characteristics two to three times better than those of conventional sand-backfilled drainage systems. The Hydraway drain is also asserted to be more resistant to clogging from dirt, gravel and sand transported by the water drained through the system.

The filter and contained support of the Hydraway drain are generally rectangular, conveniently 12, 18 or 36 inches wide, about 1 to 3 inches thick, and variable in length, preferably up to 200 to 400 feet long. A filter dimensioned in this fashion is particularly advantageous in its ease of installation; a 4 inch wide trench of appropriate depth is dug by a conventional trencher, and an appropriately dimensioned boot can position the drain against the inside wall of the trench, in a continuous process of installation. The trench can conveniently be immediately backfilled with the just-excavated material, which reduces the amount of "spoils" which need to be removed. The trench is sufficiently narrow that settling of the adjacent ground is minimized, and is sufficiently narrow to avoid entrapment of vehicle tires therein, if traffic encroaches upon the highway shoulder. The cost and delay of backfilling with sand or an aggregate is thus also avoided. Additionally, the cost of manufacture of the Hydraway drain is asserted to be significantly less than the costs of conventional drains.

One drawback of the Hydraway drainage system lies in the outlet and union structures employed in it. These structures fluidly connect an open end of the tubular filter to a drainpipe or to other filters. Several inconveniences have arisen during the use of these structures. The exit end of the filter slips into an open end of the outlet or other structure employed, and is retained in place by an encircling piece of fabric carried by the outlet or other structure, or by stapling and wrapping with tape. This is disadvantageous in the amount of time and effort needed to be certain that the filter has not caught the fabric piece in the open outlet end, and needed to manipulate the fabric piece to extend it sufficiently over the filter to attach the filter to the outlet or structure. Of course, such attachment is hardly secure, as the filter may slide from the outlet or other structure if pulled during installation, or stressed during settling of the ground after installation. Moreover, the open end of the outlet or other structure is dimensioned very closely to the outside diameter of the filter. If the area of installation is muddy or gravelly, sliding of the filter into the opening may be hindered, and mud or gravel may be trapped between the fabric of the filter and the retaining fabric on the outlet. Additionally, the outlet is dimensioned only to accommodate a standrad 4 inch drainpipe. The outlet requires a separate adapter fitting if it is desired to instead affix the outlet to a conventional flexible pipe. The known adapter fitting includes a piece of standard diameter pipe which must be bonded to the outlet. These drawbacks are costly in that they create trouble or delay precisely at the point of installation, after the trench has been cut, and after the "spoils" are exposed to the elements.

SUMMARY OF THE PRESENT INVENTION

The present invention overcomes these and other drawbacks by providing an outlet structure for use in conjunction with drainage systems of this type which makes the systems easier and thus less costly to install. The word "outlet" is employed in its broadest sense, as any structure fluidly connecting an upstream and a downstream fluid passageway, and thus includes junctions, unions, and the like. The drainage system according to the present invention is useful for directing water to a drainpipe, and comprises a fabric tube having a discharge end, a selfsustaining water porous support disposed in the fabric tube and extending generally up to the discharge end of the tube, and an outlet fluidly connecting the discharge end of the fabric tube and the drainpipe. The outlet includes an open end dimensioned to compressively receive and retain the discharge end of the fabric tube and the support therein. The invention is characterized in that at least one of the outlet and the support is stiff but slightly resilient, this resiliency creating the compression retaining the tube and support in the open end of the outlet.

Preferably, the outlet includes a flared portion on its open end which facilitates insertion of the discharge end of the fabric tube and the support into the outlet. The outlet also preferably includes a plurality of inwardly depending ramp surfaces projections which engage the fabric tube and the support so that the fabric tube is trapped between the support and the outlet. Also preferably, the outlet includes a corrugated tubular end opposite the open end, for attaching either a straight or a flexible drainpipe to the outlet. Conveniently, the tubular outlet end is molded as a single piece with the remainder of the outlet. Alternatively, when configured as a union, the outlet end of the outlet is configured the same as the inlet end, and the drainpipe comprises a fabric tube and support configured the same as the inlet tube and support.

The drain structure of the present invention is particularly advantageous in that the flared portion on the outlet and the retaining projections allow compressive attachment of the fabric tube and support to the outlet, attachment which is quicker and less susceptible to impairment than is the existing method and structure for attaching such drains to their associated outlets. Moreover, the ramped projections serve to positively secure the fabric tube and the support in the outlet without requiring employment of additional means such as tape, staples or the like. The present invention also avoids the delay of an additional construction step required to affix an adapter for flexible pipe to the outlet. The most significant improvement of the present invention, however, is that all three of these advantages can be achieved simultaneously, minimizing the time necessary for installing a drain of this type.

BRIEF DESCRIPTION OF THE DRAWING

A better understanding of the present invention will now be had, upon reference to the following detailed description, when read in conjunction with the accompanying drawing, wherein like reference characters refer to like parts throughout the several views, and in which.

DETAILED DESCRIPTION OF THE PREFERRED

EMBODIMENT OF THE PRESENT INVENTION

Figure 1:
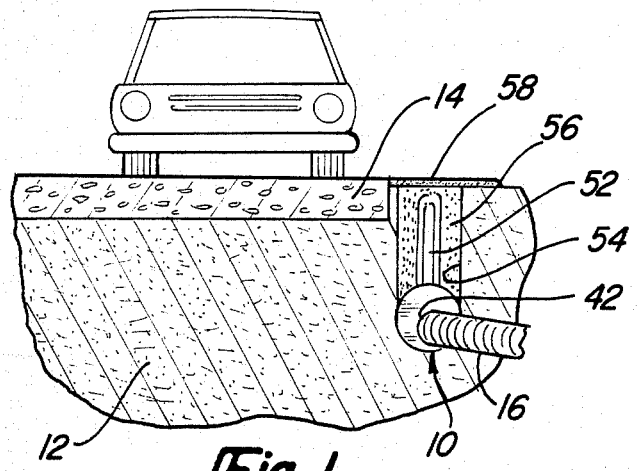
FIG. 1 is a partial cross-sectional view of the preferred embodiment of the present invention.
Figure 2:
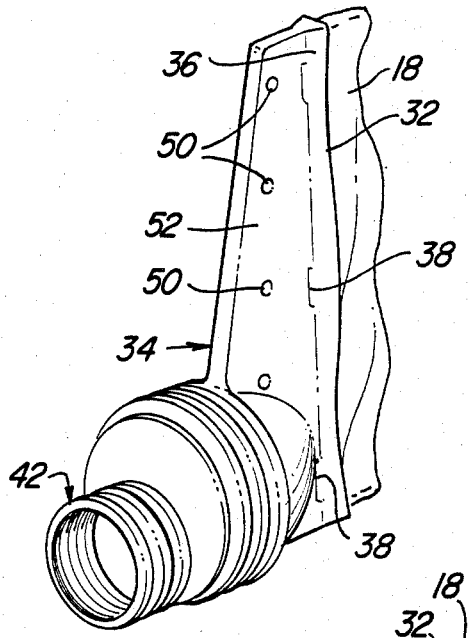
FIG. 2 is a perspective view of the preferred embodiment of the present invention.
Figure 3:
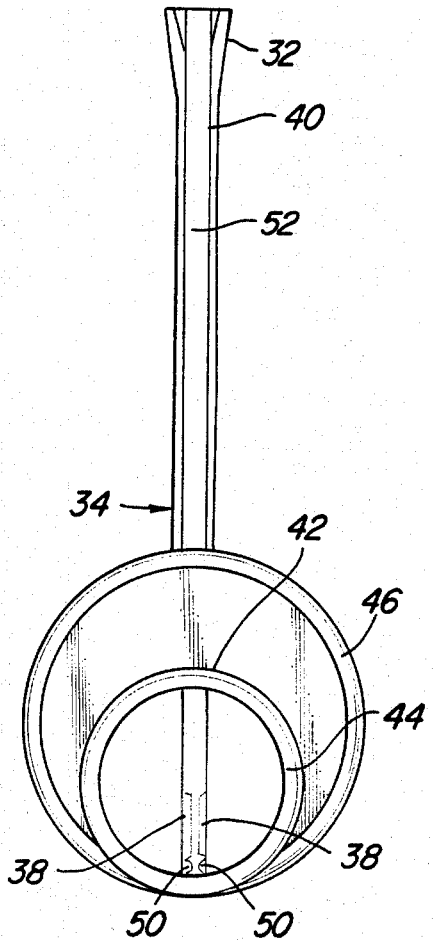
FIG. 3 is an end view of the preferred embodiment of the present invention.
Figure 4:
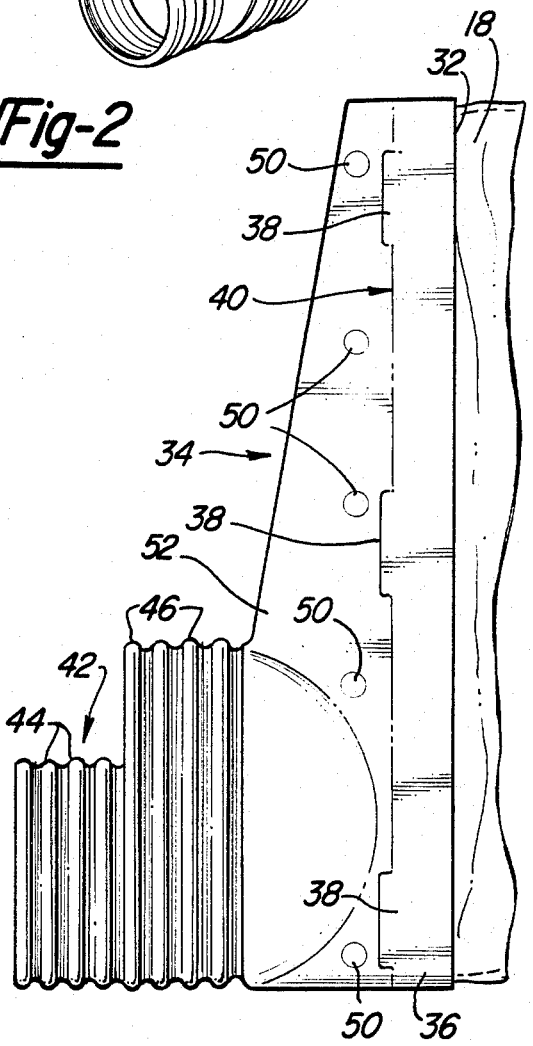
FIG. 4 is a side view of the preferred embodiment of the present invention.
Figure 5:
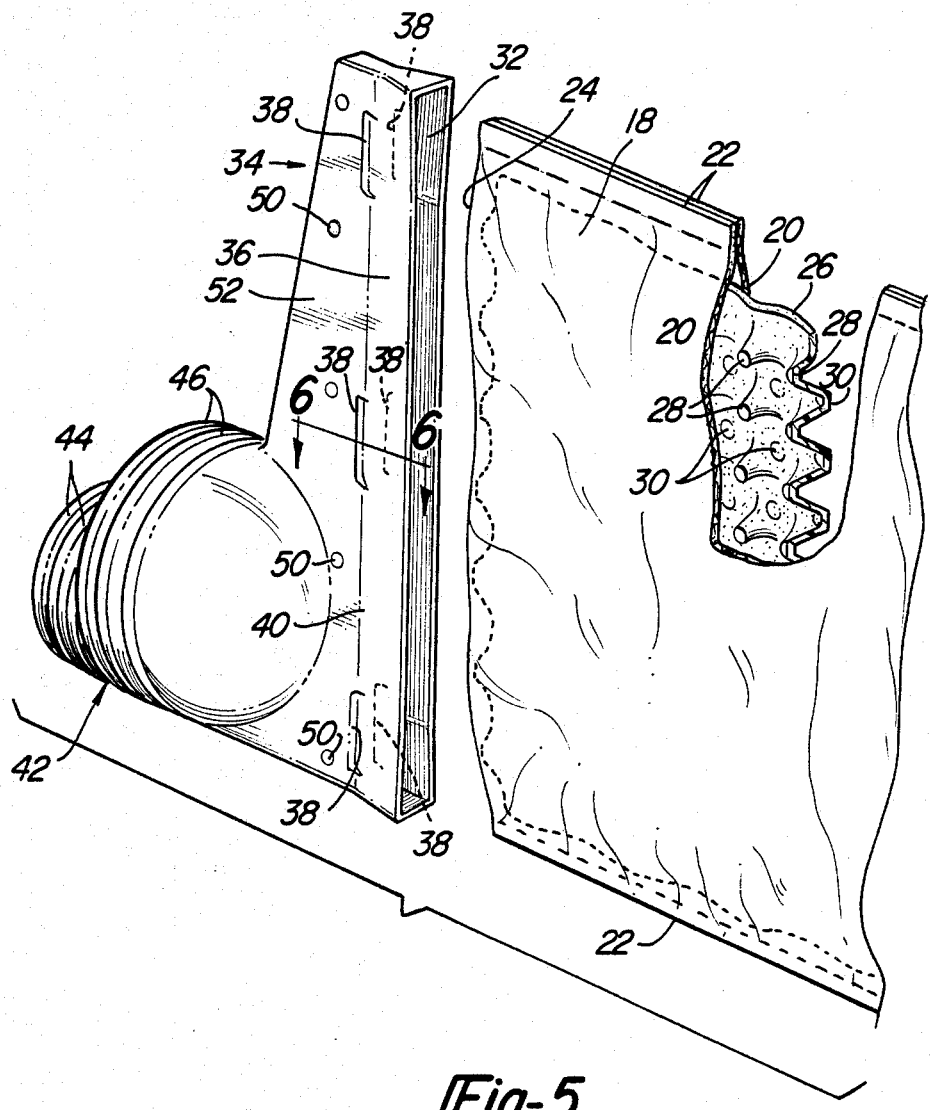
FIG. 5 is an exploded partial perspective view of the preferred embodiment of the present invention.
Figure 6:
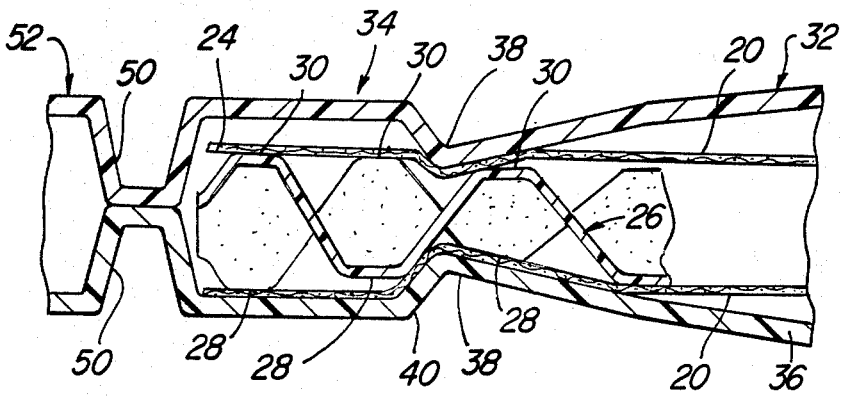
FIG. 6 is a cross-sectional view taken along line 6—6 of FIG. 5.

With reference first to FIG. 1, a first preferred embodiment of the drainage system 10 according to the present invention is thereshown disposed in a pavement subbase 12 adjacent a stretch of ground cover, for example, a piece of pavement 14. The system 10 is connected to a drainpipe 16 for drainage of water from the subbase 12 through the system 10 and out the pipe 16.

With reference now to FIGS. 2 through 5, the drainage system 10 of the present invention is further shown and first comprises at least one fabric filter inlet tube 18 constructed from an elongated pair of fabric segments 20 which are affixed together by sewing at their longitudinal edges 22. The fabric tube 18 is constructed of a fabric which is resistant to biological action and preferably comprises a geotextile material, such as nonwoven spunbonded polypropylene. Conveniently, the pair of fabric segments 20 can be part of a single piece of fabric which is folded over to bring the longitudinal edges 22 into abutment for sewing. In any event, the fabric tube 18 is disposed along the edge of the pavement 14, preferably extending somewhat beneath the level of the pavement 14, and includes a preferably open discharge end 24 through which the collected water passes.

The drainage system 10 also includes a self-sustaining flexible and water porous support 26 disposed in and extending the length of the fabric tube 18, up to the open discharge end 24 of the fabric tube 18. The support 26 is preferably constructed from a sheet of inert plastic material, double cuspate in shape, and includes a regular array of a plurality of elevations 28 spaced by a similar array of symmetrically formed depressions 30. The support is preferably composed of high density polyethylene or polystyrene. The designation of these projections as elevations or depressions is made arbitrarily, relative to viewing the support 26 from one side of the support 26. In any event, the support must be constructed so as to allow water to pass through the sides 20 of the fabric tube 18, along or through the support 26, and out the discharge end 24 of the tube 18.

The system 10 of the present invention also includes an outlet 34 having at least one open inlet end 32 in which the discharge end 24 of the fabric tube 18 is received. The open inlet end 32 of the outlet 34 includes a flared portion 36, and a plurality of inwardly depending ramped projections 38 are formed on the inner edge 40 of the flared portion 36.

The outlet 34 also comprises a tubular outlet end 42 located opposite the open end 32 of the outlet 34. A first plurality of beads 44 having a first diameter are formed on the outer surface of the tubular outlet end 42, while a second plurality of beads 46 of a second, larger diameter are also formed on the outer surface of the tubular outlet end 42, but interior of the beads 44. The interior of the tubular outlet end 42 is dimensioned to slidably receive and frictionally retain therein a rigid drainpipe of conventional diameter, for example, four inches.

The tubular outlet end 42 is separated from the open end 32 of the outlet 34 by an intermediate portion 52. The outlet 34 is preferably constructed of an inert molded plastic material, being formed of a continuous substance throughout its extent. Preferably, the intermediate portion 52 of the outlet 44 includes a plurality of stops 50 depending inwardly, disposed in a line parallel to the inner edge 40 of the flared portion 36, opposite the open end 32 of the outlet 34.

Use of the system 10 according to the present invention is straightforward. A trench 54 is dug parallel to the pavement 14 of a width and height slightly larger than but generally corresponding to the width and height of the outlet 34. The length of the trench is arbitrary and preferably can be dug as a continuous process. A length of tube 18 and its associated support 26 is selected, and the open discharge end 24 of the fabric tube 18 and the enclosed supports 26 are inserted into the open end 32 of the outlet 34. The flared portion 36 of the outlet 34 permits this to be done even under muddy or gravelly conditions. The discharge end 24 of the fabric tube 18 and the encased support 26 are inserted into the open end 32 of the outlet 34 a sufficient distance past the inner edge 40 of the flared portion 36 so that the projections 38 press against the support 26 and fabric tube 18 at open locations between the elevations 28 and depressions 30 of the support, so as to retainingly trap the fabric tube 18 between the support 26 and the projections 38. The fabric tube 18 is thus supported throughout its length yet firmly retained in the outlet 34.

Once this connection is made, the outlet 34 and the fabric tube 18 along with its enclosed support 26 are disposed in the trench 54. At this time, the tubular outlet end 42 of the outlet 34 is connected to the pipe 16 in any convenient fashion. For example, if the pipe 16 is conventional flexible corrugated tubing, the end of the pipe 16 is merely slipped over and frictionally retained upon the beads 44 or the beads 46 of appropriate diameter. Alternatively, if rigid piping is used, the pipe can be slipped into the tubular outlet end 42, interiorly of the beads 44. In either case, once the outlet 34 is connected to the drainpipe 16, and the outlet 34, the fabric tube 18 and the support 26 located in the trench 54, the remainder of the trench 54 is then filled with fill material 56, and if desired, covered with a road shoulder 58.

Figure 7:
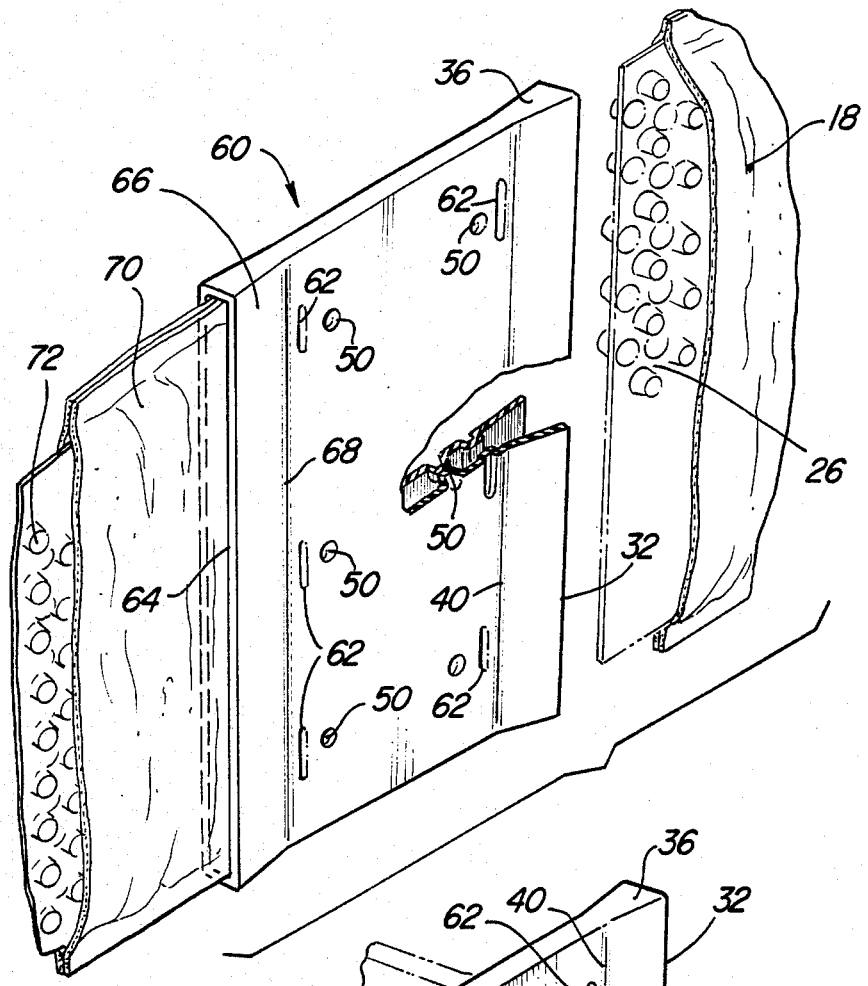
FIG. 7 is a perspective view of another preferred embodiment of the present invention.

Another preferred embodiment of the present invention is shown in FIG. 7, where the outlet is configured as a union 60 joining two sections of drain. More particularly, the union 60 is generally flat and rectangular in shape, and comprises the open inlet end 32 and flared end portion 36, described in connection with the outlet 34. The union 60 includes a plurality of elongated and rounded projections 62 located just inward of the inner edge 40 of the flared portion 36, serving the same purpose as the ramped projections 38. A plurality of the stops 50 are also included. Like the outlet 34, the open end 32 of the union 60 receives and compressively attains therein the upstream fabric inlet tube 18 and its enclosed double cuspate support 26.

The union 60 also comprises an outlet end 64 configured substantially the same as the inlet end 32, having an outwardly flared portion 66, a plurality of the projections 62 spaced slightly inward of an inner edge 68 of the portion 66, and a plurality of the stops 50. Like the open end 32, the outlet end 64 receives and compressively retains therein a downstream geotextile fabric outlet tube 70 having a double cuspate plastic support 72 contained therein. The fabric outlet tube 70 and support 72 are preferably identical to the fabric inlet tube 18 and support 26.

Figure 8:
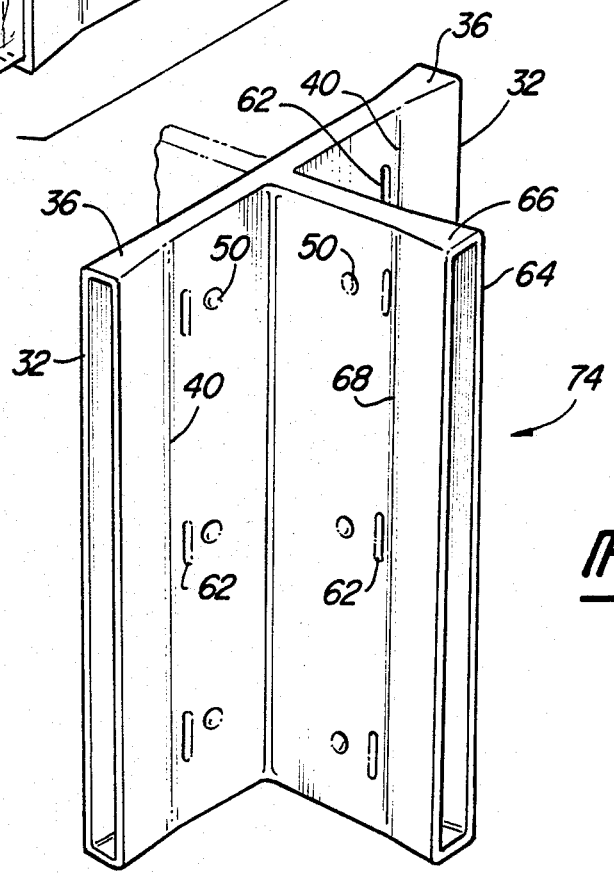
FIG. 8 is a perspective view of another preferred embodiment of the present invention.

Still another preferred embodiment of the present invention is shown in FIG. 8, where the outlet is configured as a T-shaped junction 74 including two preferably coplanar inlet ends 32 receiving therein two upstream fabric inlet tubes 18 and their contained supports 26 (not shown). The junction 74 also comprises the outlet end 64 described above, which receives and compressively retains the downstream fabric inlet tube 70 and enclosed support 72 (also not shown). The junction 74 is otherwise constructed in the same fashion as the union 60, with the corresponding flared ends 36 and 66, the projections 62 and the stops 50 performing their same functions.

The present invention thus provides several improvements over the prior drainage system. Because the fabric tube 18 and the support 26 are retained by insertion into the outlet 34, there is no time wasted in attempting to draw or fasten a second piece of fabric over them at the outlet end. Indeed such a connecting or covering piece can be excluded by the present invention, as the tube 18 and support 26 fully occlude the open end 32. Moreover, the flared portion 36 on the open end 32 of the outlet 34 allows the ready insertion of the fabric tube 18 and the support 26 into the outlet 34 even under adverse conditions. The beads 44 and 46 formed on the outside of the tubular outlet end 42 also speed installation of the system, by allowing connection of the outlet 34 to both straight pipe and corrugated pipe drains 16 without requiring an additional fitting. Lastly, the projections 38 serve to retain the fabric tube 18 and support 26 in the open end 32 of the outlet 34 without requiring any additional securing or attaching means.

Conveniently, the fabric tube 18, support 26 and open end 32 of the outlet 34 are provided in dimensions 6 to 60 inches (in crements of inches), either $\frac{3}{4}$ or $1\frac{1}{2}$ inches thick, and upwards of 200 to 400 feet in length. The first beads 44 are sized to receive a six inch nominal diameter flexible pipe thereon, while the second beads 46 are sized to receive an eight inch nominal diameter flexible pipe thereon. The inside diameter of the tubular end 42 is preferably four inches.

Also conveniently, the support 26 has a waffle-like profile, porous in all directions and along bot sides of its dimensional plane. It preferably has a compressive strength (ASTM D162mod.) of at least about 5000 psf. Additionally, the fabric tube 18 has a water transmitivity of 22 U.S. gpm/sq. ft. (at 2000 lb./ftt, i=1). When constructed of the preferred materials and structured according to the particulary described embodiment, the system transmits water along each side of the tube at a rate of at least about 5 gpm per foot of support width, at a lateral earth pressure of 10 psi. Such a structure, however, weighs merely about 0.20 lb./sq.ft. of lateral area.

Having described my invention, however, many modifications thereto will become apparent to those skilled in the art to which it pertains, without deviation from the spirit of the invention, as defined by the scope of the appended claims.

I claim:

1. A drainage system directing water to a drainpipe, a catch basin or an outlet pipe, comprising:

at least one fabric inlet tube having a discharge end;

a self-sustaining, rectangular water-porous inlet support disposed in said at least one fabric inlet tube, an end of said support extending generally up to said discharge end of said inlet tube; said support being composed of a substantially rigid plastic sheet including a regularly spaced array of alternating elevations and depressions, so as to define spaces between alternating elevations and spaces between alternating depressions; said fabric tube extending over said spaces so as to be generally flat in shape, but being deformable to fit into at least some of said spaces; and an outlet fluidly connecting said discharge end of at least one inlet tube and said drainpipe, catch basin or outlet pipe;

wherein said outlet includes at least one generally flat open end including a rectangular opening dimensioned to compressively receive and retain said discharge end of said inlet tube and said end of said support therein, one of said outlet and said support being stiff but slightly resilient;

wherein said open end of said outlet includes an outwardly flared portion facilitating insertion of said fabric tube discharge end and said support end into said outlet open end; and wherein said outlet includes a plurality of inwardly depending projections, located interiorly of said rectangular opening, said projections being dimensioned so as to deform said fabric tube upon insertion so as to fit said fabric tube into said at least some of said spaces of said support and trap said fabric tube between said support and said outlet.

2. The invention according to claim 1, wherein said projections are formed as a plurality of ramp surfaces on said outlet.

3. The invention according to claim 1, wherein said projections are located along an interior edge of said outwardly flared portion of said open end of said outlet.

4. The invention according to claim 1, wherein said outlet is composed of a stiff but slightly resilient plastic.

5. The invention according to claim 1, wherein said support is generally rectangular.

6. The invention according to claim 1, wherein said fabric tube is composed of a pair of elongated fabric segments affixed together at their longitudinal edges.

7. The invention according to claim 6, wherein said segments are part of a single fabric piece, folded over upon itself to bring said edges into abutment with one another.

8. The invention according to claim 6, wherein said segments are sewn together.

9. The invention according to claim 1, wherein said outlet includes a tubular outlet end and means formed on said tubular outlet end for attaching said drainpipe to said outlet, said attaching means comprising at least one radially outwardly extending circumferential bead formed on said tubular outlet end.

10. The invention according to claim 9, wherein said attaching means comprises a plurality of equally spaced circular beads.

11. The invention according to claim 9, wherein said tubular outlet end includes a pair of stepped diameters and said attaching means comprises a plurality of equally spaced circular beads on each of said diameters.

12. The invention according to claim 11, wherein the smaller of said stepped diameters possesses an interior diameter of about four inches.

13. The invention according to claim 9, wherein said tubular outlet end is formed of a substance continuous with the substance of the remainder of the outlet.

14. The invention according to claim 1, wherein said outlet is about eighteen inches tall.

15. The invention according to claim 1, wherein said drainpipe comprises a fabric outlet tube and a water-porous outlet support, configured the same as said at least one fabric inlet tube and said inlet support, respectively; and wherein said outlet includes an outlet end configured the same as said at least one open end.

16. The invention according to claim 15, wherein said outlet is a flattened rectangle in shape.

17. The invention according to claim 15, wherein said at least one fabric inlet tube is two in number.

18. The invention according to claim 17, wherein said outlet is T-shaped in cross section.

19. The invention according to claim 1, wherein said at least one fabric inlet tube is two in number.

20. The invention according to claim 19, wherein said outlet is T-shaped in cross section.

21. The invention according to claim 1, wherein said projections are formed as rounded elongated beads on said outlet.

22. The invention according to calim 1, wherein said support comprises high density polyethylene or polystyrene.

23. The invention according to claim 1, wherein said fabric tube comprises nonwoven, spunbonded polypropylene.

* * * * *